United States Patent [19]

Rausing

[11] 4,090,343

[45] May 23, 1978

[54] PACKAGE INTENDED FOR PRESSURIZED CONTENTS

[75] Inventor: Gad Anders Rausing, Lund, Sweden

[73] Assignee: Tetra Pak Developpement SA, Lausanne, Switzerland

[21] Appl. No.: 685,773

[22] Filed: May 12, 1976

[30] Foreign Application Priority Data

Oct. 17, 1972 Switzerland ..... 15144/72

[51] Int. Cl.[2] ..... B65B 41/18

[52] U.S. Cl. ..... 53/27; 53/176

[58] Field of Search ..... 53/27, 28, 170, 169, 53/176; 229/55, 14 B; 426/106, 110, 410, 411; 206/52

[56] References Cited

U.S. PATENT DOCUMENTS

| | | | |
|---|---|---|---|
| 787,100 | 4/1905 | Lazaga | 53/169 |
| 2,928,216 | 3/1960 | Orsini | 53/28 X |
| 3,246,744 | 4/1966 | Marnon | 53/27 X |
| 3,407,562 | 10/1968 | Di Nicola | 53/27 X |
| 3,423,005 | 1/1969 | Leibson | 229/14 B |
| 3,466,841 | 9/1969 | Rausing | 53/28 |
| 3,710,539 | 1/1973 | Cothran et al. | 53/27 |
| 3,913,738 | 10/1975 | Olsen | 53/27 X |
| 3,924,008 | 12/1975 | Ford et al. | 426/106 |

*Primary Examiner*—Othell M. Simpson
*Assistant Examiner*—John Sipos
*Attorney, Agent, or Firm*—Burns, Doane, Swecker & Mathis

[57] ABSTRACT

The invention is concerned with a process of making a package of pressurized fluid, said package having an inner container of plastics and a shell of non-extensible material. A tube of flexible plastics is filled with a gas-containing fluid (e.g., beer), and sealed along two parallel sealing zones, spaced from each other by a distance less than the length of the seals, and cut along the seals thereby forming a filled container. This latter is immediately enclosed in a stiff outer shell or sleeve, open at its ends, the filled container's seams being wholly within the shell so that the portions of the container accessible at the ends of the shell are seamless.

3 Claims, 4 Drawing Figures

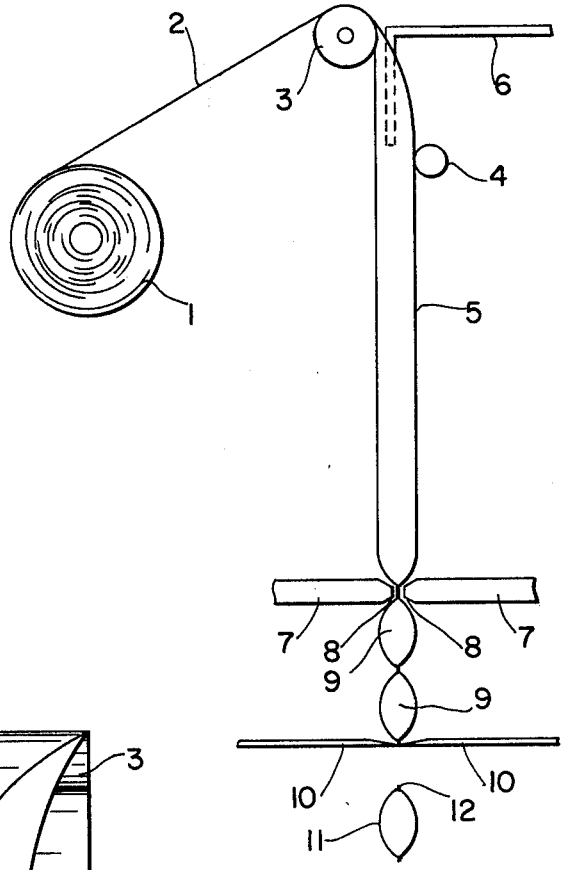
FIG. 1
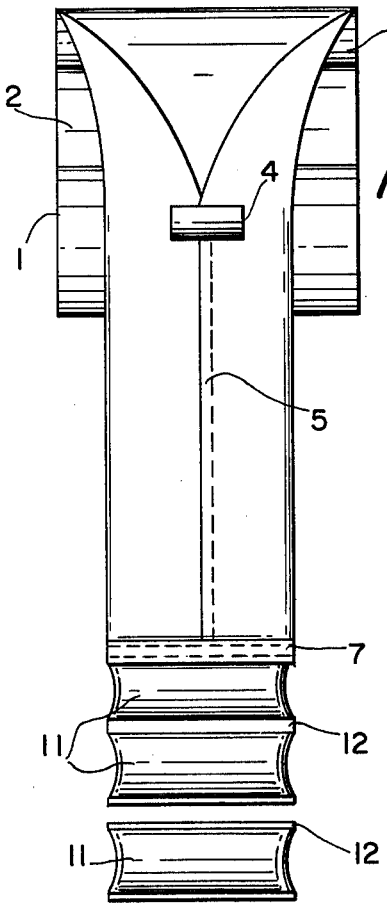
FIG. 2
FIG. 3
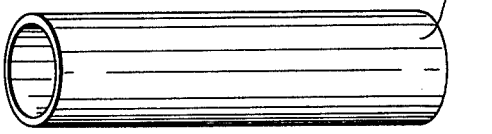
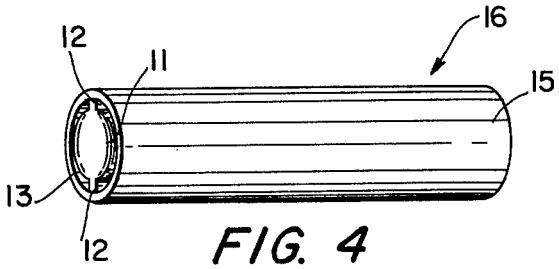
FIG. 4

PACKAGE INTENDED FOR PRESSURIZED CONTENTS

The present invention relates to a method of producing a package having a pressurized content and comprising an inner container of plastic material, a filling of fluid, and a shell of a non-extensible material, e.g., paper, enclosing the filled container.

It is known that for the packaging of pressurized contents a plastic container can be used into which the contents are placed and which can be tightly sealed and which container is designed so that certain parts by virtue of their geometrical shape, e.g., dished or conical shape, are capable of absorbing stresses emanating from the contents whilst on the other hand other parts of the container, in particular a cylindrical portion between the end parts, are not capable without deformation to absorb the stresses emanating from the contents. This portion which is located between the end parts can then in a known manner be provided with an outer shell of a non-extensible material, which shell surrounds the parts of the inner container which require to be supported and which absorbs the forces which act upon the supported portion of the inner container.

The said inner container may be manufactured of a relatively rigid plastic, but it may also be manufactured of soft and flexible plastic tube, the ends of which are closed by means of heat-sealing transversely to the longitudinal axis of the tube after the same has been filled with the intended contents. When the contents consist of beer or other liquid containing carbon dioxide under pressure it is naturally important that the plastic material should be so gas-tight that the carbon dioxide does not diffuse out or oxygen gas diffuses in through the walls of the container, and it can in certain cases be appropriate to manufacture the tube of a laminate, where at least one plastic layer included in the laminate has the required gas barrier properties.

In the manufacture of known packing containers of the above-mentioned type it was found difficult to achieve sufficient mechanical strength of the transverse seals of the tube which project outside the said outer shell or which are exposed in the opening of the said shell. Thus it was found that it is not sufficient to seal off the tube by a single transverse seal, since the gas pressure inside the tube is so great that such a single transverse seal can easily be broken at normal handling and transport of the packages. Instead it was found necessary to reinforce the transverse seals by separate, folded over strips of a stronger plastic material, which makes the manufacture of the package both more expensive and more complicated.

These diadvantages are overcome in packages produced in accordance with the process of the invention, in that the transverse seams of the tube are not exposed at the openings of the outer shell, but instead are covered by the outer shell, whilst the parts of the tube which project outside or are exposed at the openings of the shell do not have any sealing seam.

The invention will be described in the following, with reference to the enclosed schematic drawing, in which FIGS. 1 and 2, in side view and front view, respectively, a flow sheet of the process of forming, filling, sealing, and severing the filled inner container;

FIG. 3 is a perspective view of a shell or sleeve for enclosing the container; and FIG. 4 is a perspective view of the finished package, showing the seamless end of the inner container accessible at the open end of the shell of the package.

In FIGS. 1 and 2, a supply roll for sheeting plastics is represented at 1; 2 is a flat sheet of plastics; and 3 is an idler roll. At 4 there is diagrammatically represented a known device for shaping the sheet 1 into tubular form and for making a longitudinal seam along the brought-together edges of sheet 1 to form a continuous longitudinally seamed tube 5. At 6 there is diagrammatically represented a known filling device for delivering liquid into the tube as the same is formed.

At 7, 7, there are represented a pair of cooperating sealing jaws for pressing together the walls of tube 5 and heatsealing the pressed-together parts into a sealing zone 8.

The rate of descent of tube 5 and the frequency of sealing jaws 7, 7 are so coordinated as to hold to a predetermined interval the spacing between each two adjoining sealing 8, 8 to determine the diameter of each successive cylindrical mass 9 therebetween and hence its volume.

Spaced beneath sealing jaws 7,7 is a knife device 10 for severing each individual cylindrical mass 9 from the series. Device 10's cut is predetermined to occur within sealing zone 8. The severed filled container is represented at 11, with parallel seams 12, 12 at its upper and lower edges.

At 15 in FIG. 3 there is represented a stiff open-ended shell or sleeve 15 formed of paper or a rigid plastic. In FIG. 4 the finished product 16 is illustrated. Shell 15 is shown surrounding a sealed container 11 with the seams 12, 12 of the latter fully shielded within 15 and with a seamless portion 13 exposed at an end of shell 15.

In carrying out the process of the invention, the packaging material 2 which is a flexible plastic material, is rolled off the supply roll 1 and brought over the top roll 3 as a plane web. Immediately after the web has passed the top roll it is folded by means of conventional folding and guiding means to a mainly flat tube, and the edges of the web are brought together in an overlap seam and welded together by means of a device 4 for making said longitudinal seam which is located at a distance from the edges of said flat tube. This device can preferably be a counter pressure roll on the inside of the tube 5 and a heated roll on the outside of the tube. A filling tube 6 is inserted in the open-ended flat tube 5 and the filling goods is introduced into the tube, which of course will be widened a little by the filling but still the tube is mainly flat or at least has a longitudinal cross-section. The tube is thereafter sealed through the filling goods by means of heated sealing jaws 7, 7 which means that a certain amount of filling goods will be trapped between two adjacent seale 8, 8. If the filling goods is beer or another liquid containing a gas like carbon hydroxide, the pressure will immediately inrease as the gas "generated" by the liquid cannot escape from the container 9. Therefore the sealed off container parts 9 will very soon have a mainly circular cross-section. In a further step the sealed containers are severed from the tube by means of knife-device 10, 10 and as soon as possible, and necessarily before the internal pressure is built up to such a degree that the container part is deformed beyond its final outer contour, brought into a considerably stiff outer shell 15 of the kind mentioned hereinabove, which outer shell takes up the stresses emanating from the pressurized filling goods and protects the seals 12, 12 which are the weakest part of container 11.

As has been mentioned above, the internal pressure in the container 11 will be built up very rapidly after the sealing operation, and therefore it is important that the containers are introduced in the outer shell as soon as possible as in other case the internal pressure can rupture the newly made transverse seals 12, 12 and it will also be more difficult to place the containers in the outer shell if the pressure is too high and the containers are deformed. The best way to provide the containers with the outer shell 15 is to roll a web of e.g., paper around the containers several turns and to seal the overlapping parts of said web against each other by means of heat sealing or by means of a hot melt or a glue. In the alternative, the shell may be preformed and the freshly severed container slipped within it.

The operation of filling the gas-containing fluid into the tube and sealing off the filled tube into a series of filled containers is best carried out at a temperature lower than normal room temperature in order to avoid pressure build up of the filled container prior to its encasement within the confines of the outer shell.

I claim:

1. Process of forming a package of a fluid containing a gas dissolved therein, which comprises forming a web of gas-impermeable plastics material into a tube;

introducing into said tube a filling of a refrigerated fluid containing a gas dissolved therein sealing the tube at spaced intervals to form a series of connected sealed filled containers connected by sealing zones between adjacent containers;

severing each filled container, promptly as formed, from the series by cutting through each sealing zone whereby each so-severed filled container is characterized by two sealed seams along opposite sides of a generally cylindrical container having seamless ends; and promptly enclosing each said severed filled container within a stiff open-ended shell with the seams parallel to the longitudinal axis of the shell and in contact with, and fully shielded by, said shell, any part of the container accessible at an open end of the shell being seamless.

2. The process defined in claim 1 in which said shell is formed in situ by wrapping several turns of stiff paper about the severed filled container and securing the wrap by an adhesive.

3. The process defined in claim 1, in which the freshly severed container is slipped within a preformed shell with its seams parallel to the longitudinal axis of the shell.

* * * * *